US005630849A

United States Patent [19]

Kameoka et al.

[11] Patent Number: 5,630,849

[45] Date of Patent: May 20, 1997

[54] DYEING METHOD

[75] Inventors: Taiji Kameoka, Chiba-ken; Isamu Kawamura; Isamu Ghoda, both of Hyogo-ken; Masanobu Ajioka, Kanagawa-ken; Keisuke Takuma, Kanagawa-ken; Akihiro Yamaguchi, Kanagawa-ken; Hiroshi Suizu, Kanagawa-ken, all of Japan

[73] Assignee: Mitsui Toatsu Chemicals, Inc., Tokyo, Japan

[21] Appl. No.: 612,578

[22] Filed: Mar. 8, 1996

[30] Foreign Application Priority Data

Mar. 14, 1995 [JP] Japan ..... 7-054483

[51] Int. Cl.$^6$ ..... D06P 3/16; D06P 3/54

[52] U.S. Cl. ..... 8/489; 8/494; 8/922

[58] Field of Search ..... 8/512, 922, 933, 8/532, 533, 494, 489

[56] References Cited

U.S. PATENT DOCUMENTS 3,502,422 3/1970 Miller et al. ..... 8/512

4,531,947 7/1985 Engelhardt ..... 8/512

5,201,922 4/1993 Seto et al. ..... 8/922

*Primary Examiner*—Margaret Einsmann

*Attorney, Agent, or Firm*—Burns, Doane, Swecker & Mathis

[57] ABSTRACT

The invention is a method of dyeing aliphatic polyester filaments with a disperse dye by selecting a dyeing temperature, dyeing pH, and dyeing time in such a way that the weight average molecular weight of the aliphatic polyester filament has a lowering ratio of 20% or less.

The invention is a method for dyeing the aliphatic polyester filament with good reproducibility and level dyeing property while substantially maintaining the molecular weight and the essential excellent properties of the aliphatic polyester filament, and can provide dyed articles which have high strength, are excellent in level dyeing property and color fastness to light, and have various hues.

12 Claims, No Drawings

DYEING METHOD

BACKGROUND OF THE INVENTION

1) Field of the Invention

The present invention is a dyeing method comprising dyeing an aliphatic polyester filament with a disperse dye by selecting a dyeing temperature, dyeing pH and dyeing time in such a way that an weight average molecular weight of the aliphatic polyester filament to be dyed has a lowering ratio of 20% or less after dyeing.

More particularly, the invention relates to a dyeing method of the aliphatic polyester filament by a disperse dye with good dyeing reproducibility and level dyeing, while substantially maintaining during dyeing the molecular weight and excellent properties of the aliphatic polyester filament. The dyed article obtained by the dyeing method of the invention has a high strength, various hues, and excellent color fastness to light.

2) Description of the Related Art

Conventionally, resins which can be widely used for clothing filaments and films are nylon resin, aromatic polyester resin such as polyethylene terephthalate (PET) and polybutylene terephthalate (PBT), polypropylene resin and polyethylene resin.

However, filaments prepared from these resins have very slow degradation velocity in the natural environment and thus semipermanently remain when these filaments are subjected to landfill or other waste disposal after use. When plastic prepared from these resins are abandoned, these plastics lead to problems by giving an adverse effect on the scenery and damaging the living environment of marine organisms.

Recently in view of these problems, aliphatic polyester resins which are friendly for the environment have been known as substitutes for these general purpose plastic articles.

The aliphatic polyester resin can be generally degraded with ease. For example, the resin undergoes hydrolysis with relative ease in the presence of water and is also degraded by microorganisms. Thus, the resin can be safely used for filament products, molded articles and other various uses.

When aliphatic polyester resin is used for a filament of clothing, it is desired to dye the filament to various hues in view of appearance and fashion.

Dyeing techniques for an aromatic polyester filament such as PET or PBT have been established for a long time. On the other hand, a dyeing technique for an aliphatic polyester filament remains unknown.

As mentioned above, aliphatic polyester resin is degraded with ease. As a result, when the known and commonly used dyeing technique of aromatic polyester filaments is simply and analogously applied to aliphatic polyester, the dyeing operation is liable to decompose the aliphatic polyester resin and to cause deterioration accompanied by molecular weight reduction.

A report of focusing attention on the ready decomposability of an aliphatic polyester resin and investigating the effect of dyeing conditions such as temperature, time and pH in the dyeing operation of aliphatic polyester filaments on the decrease in the weight average molecular weight of the aliphatic polyester resin after the dyeing operation was not known before the present invention.

SUMMARY OF THE INVENTION

The present inventors have carried out an intensive investigation, in view of the decomposability of an aliphatic polyester resin, on the relationships of dyeing conditions such as temperature, time and pH in the dyeing operation of an aliphatic polyester filament to the decrease in an weight average molecular weight of the aliphatic polyester resin after dyeing operation. As a result, they have found that the dyeing conditions such as temperature, time and pH have remarkable effect on the decrease in the weight average molecular weight of the aliphatic polyester resin after the dyeing operation, and that the molecular weight reduction of the aliphatic polyester filament to be dyed can be inhibited by employing specific dyeing conditions. Thus, the present invention has been completed.

That is, one aspect of the invention is a dyeing method of an aliphatic polyester filament comprising dyeing the aliphatic polyester filament with a disperse dye by selecting a dyeing temperature, dyeing pH and dyeing time in such a way that an weight average molecular weight of the aliphatic polyester filament to be dyed has a lowering ratio of 20% or less after dyeing.

Another aspect of the invention is a dyeing method comprising dyeing an aliphatic polyester filament with a disperse dye by selecting a dyeing temperature, dyeing pH and dyeing time so as to make the tensile strength of the aliphatic polyester filament 2 g/denier or more after dyeing.

That is, in the case of dyeing the aliphatic polyester filament, the aliphatic polyester resin to be dyed leads to molecular weight reduction and remarkable change in physical properties such as reduction of strength unless dyeing is carried out under specific conditions. On the other hand, dyeing under the specific conditions can substantially inhibit the molecular weight reduction of the aliphatic polyester to be dyed and can maintain essentially excellent properties of the aliphatic polyester resin.

DETAILED DESCRIPTION OF THE INVENTION

The aliphatic polyester filament which can be used in the invention includes yarn, filament and textile prepared from the aliphatic polyester resin.

Yarns and filaments which can be used in the invention include, for example, monofilament, multifilament, staple fiber, tow, high bulk staple fiber, high bulk tow, spun yarn, blended yarn, finished yarn, twisted yarn, modified cross-section yarn, hollow yarn, conjugate yarn, partially oriented yarn (POY), drawn textured yarn (DTY), POY-DTY, and sliver.

Exemplary, textiles which can be used in the invention include common materials which are recognized to have fiber structure such as woven fabric, knitted webs, non-woven fabrics, braids including a string and rope, cotton like high bulk staple fiber, sliver, porous sponge, felt, paper and nets.

The aliphatic polyester filament of the invention has degradability. That is, the aliphatic polyester filament which can be used in the invention is degraded in water, sea water, soil or compost, or hydrolyzed in an aqueous alkali solution.

The aliphatic polyester resins which can be used for the raw material of the aliphatic polyester filament in the invention include a polymer and copolymer of aliphatic hydroxycarboxylic acid and aliphatic polyester obtained by polycondensation of aliphatic polybasic acid and aliphatic polyhydric alcohol.

The polymer or copolymer of aliphatic hydroxycarboxylic acid in the invention is a homopolymer or copolymer of lactic acid, glycolic acid, 3-hydroxybutyric acid, 4-hydroxybutyric acid, 4-hydroxyvaleric acid, 5-hydroxyvaleric acid and 6-hydroxycaproic acid, and includes, for example, polylactic acid, polyglycolic acid, poly-3-hydroxybutyric acid, a copolymer of 3-hydroxybutyric acid and 3-hydroxyvaleric acid, and poly-ε-caprolactone.

Particularly preferred are polylactic acid, poly-ε-caprolactone and a copolymer of lactic acid and 6-hydroxycaproic acid.

When an asymmetric carbon atom is present in aliphatic hydroxycarboxylic acid, a D-isomer or L-isomer can be individually used or as a mixture of D- and L-isomers, that is, a racemic isomer.

The polymers or copolymers of these aliphatic hydroxycarboxylic acid can be obtained by direct dehydration condensation of the above aliphatic hydroxycarboxylic acid or by ring-opening polymerization of a cyclic dimer, for example, lactide or glycolide or a cyclic ester, for example, ε-caprolactone.

Aliphatic polyhydric alcohols which can be used for the raw material of aliphatic polyester in the invention are compounds having aliphatic hydroxyl groups in the molecule and include, for example, ethylene glycol, diethylene glycol, triethylene glycol, polyethylene glycol, propylene glycol, dipropylene glycol, 1,3-butanediol, 1,4-butanediol, 3-methyl-1,5-pentanediol, 1,6-hexanediol, 1,9-nonanediol, neopentyl glycol, polytetramethylene glycol, 1,4-cyclohexanedimethanol and 1,4-benzenedimethanol. These polyhydric alcohols can be used singly or as a mixture.

When an asymmetric carbon atom is present in the molecule, a D-isomer and L-isomer can be individually used singly or as a mixture of the D-isomer and L-isomer, that is, a racemic isomer.

Aliphatic polybasic acids which can be used as a raw material of aliphatic polyester in the invention are compounds having aliphatic carboxyl groups in the molecule and include, for example, succinic acid, oxalic acid, malonic acid, glutaric acid, adipic acid, pimelic acid, suberic acid, azelaic acid, sebacic acid, undecanoic diacid, dodecanoic diacid, phenylsuccinic acid and 1,4-phenylenediacetic acid. These acids can be used singly or as a mixture. A chain extender can also be added when necessary.

When an asymmetric carbon is present in a molecule, D-isomer and L-isomer can be individually used singly or as a mixture, that is, a racemic isomer.

Various kinds of aliphatic polyester resins which can be used for the filaments of the invention are prepared by polycondensation of the above aliphatic polybasic acid and aliphatic polyhydric alcohol through a known method. Preferred aliphatic polyester resin can be obtained when aliphatic polybasic acid is succinic acid or adipic acid and aliphatic polyhydric alcohol is ethylene glycol or 1,4-butanediol. That is, the aliphatic polyester resins which can be used for the filament of the invention are preferably polybutylene succinate, polyethylene succinate and polybutylene adipate.

A copolymer prepared from hydroxycarboxylic acid, aliphatic polybasic acid and aliphatic polyhydric alcohol, for example, a copolymer of polylactic acid and polybutylene succinate can also be preferably used as an aliphatic polyester resins of the invention.

The aliphatic polyester resin which can be used for the invention can be processed by suitably setting yarn-making conditions, spinning conditions, textile conditions, post treatment conditions, dyeing conditions and other processing conditions depending upon the object into yarn and textile having desired properties and characteristics which include size, sectional form, fineness such as tex, denier and yarn count; twist, tensile strength and elongation, tying strength, heat resistance, crimping degree, water absorption, oil absorption, bulking power, drape, and feeling.

The aliphatic polyester resin which can be used for the invention can be spun by known methods. These methods are a melt spinning method which carries out spinning in a molten state by using an extruder, wet spinning method which dissolves the resin into a solvent to make a solution and extrudes the solution from a nozzle into a lean solvent, and a dry spinning method which extrudes the solution from a nozzle into dry gas.

For example, when the melt spinning method is employed, the spinning temperature can be suitably set on the basis of the kind and molecular weight of the polymer and is preferably 100°–300° C. in most cases, more preferably 130°–250° C. When the temperature is less than 100° C., melt viscosity increase and spinning tends to be difficult. On the other hand, a temperature higher than 250° C. is liable to cause decomposition.

In the case of resins having relatively slow crystallization velocity like an aliphatic polyester resin which is primarily comprised of polylactic acid, the filament is amorphous after spinning and is liable to cause deformation, coalescence or undesired hardening in the course of dyeing.

The aliphatic polyester resin used in the invention can be provided with more preferable properties by further drawing and heat-setting after spinning the resin.

Drawing conditions such as drawing temperature and draw ratio can be suitably selected depending upon the kind of aliphatic polyester resin. The drawing temperature is usually in the range of from the glass transition temperature to the melting point of the high polymer raw material. In the case of the aliphatic polyester resin primarily comprised of polyhydroxycarboxylic acid, the drawing temperature is preferably 60°–160° C., more preferably 80°–140° C. In the case of the aliphatic polyester resin primarily comprised of aliphatic polyester, the drawing temperature is preferably 0°–100° C., more preferably 40°–90° C.

The draw ratio is preferably 2–20 times in most cases, more preferably 4–19 times.

The heat-setting condition is suitably selected depending upon the aliphatic polyester resin raw material. The heat-setting is usually carried out in a temperature range from the glass transition temperature to the melting point of the aliphatic polyester resin raw material. In the case of an aliphatic polyester resin primarily comprised of polyhydroxycarboxylic acid, the heat-setting temperature is preferably 80°–160° C., more preferably 120°–150° C. In the case of an aliphatic polyester resin primarily comprised of aliphatic polyester, the heat-setting temperature is preferably 20°–110° C., more preferably 60°–100° C. The heat-setting temperature is usually higher than the drawing temperature.

The aliphatic polyester resin which can be used for the invention can be incorporated, when necessary, with a plasticizer, antioxidant, heat stabilizer, ultraviolet stabilizer, ultraviolet absorber, light stabilizer, lubricant, filler, anti-sticking agent, antistatic agent, surface wetting improver, incineration adjuvant, non-slip agent, colorant and other additives.

In the case of dyeing the aliphatic polyester filament in the invention, dyeing is preferably carried out after drawing the aliphatic polyester filament, though it is possible to dye before drawing. When the filament is dyed before drawing, the filament must be set in order to inhibit deformation.

Disperse dyes are suitably used for dyeing the aliphatic polyester filament of the invention. Disperse dyes which can be used are azo dyes, quinophthalone dyes and anthraquinone dyes.

Exemplary azo dyes include Miketon Polyester (hereinafter referred to simply as M/P) Yellow 5G (CI Disperse Yellow 5), M/P Yellow 5GF (CI Disperse Yellow 198), M/P Yellow 5R (CI Disperse Yellow 7), M/P Orange 3GSF (CI Disperse Orange 56), M/P Orange SF (CI Disperse Orange 49), M/P Orange SC (CI Disperse Orange 31), M/P Orange B (CI Disperse Orange 13), M/P Yellow Brown R (CI Disperse Orange 29), M/P Yellow Brown 2RL (CI Disperse Orange 61), M/P Scarlet RR (CI Disperse Red 54), M/P Scarlet 3R (CI Disperse Red 56), M/P Scarlet 3RG (CI Disperse Red 205), M/P Scarlet RCS (CI Disperse Red 227), M/P Scarlet BRSF (CI Disperse Red 135), M/P Red FL (CI Disperse Red 72) M/P Red BSF (CI Disperse Red 111), M/P Red 2BSF (CI Disperse Red 88), M/P Red 3BSF (CI Disperse Red 206), M/P Rubine GGSF (CI Disperse Red 225), M/P Rubine GL (CI Disperse Red 73), M/P Violet ADW (no CI name), M/P Discharge Blue R (CI Disperse Blue 106), M/P Blue G-ADW (no CI name), M/P Blue 3RT (CI Disperse Blue 148), M/P Blue 3RSF (CI Disperse Blue 128), M/P Blue 2RF (CI Disperse Blue 183), M/P Blue 7 GSF (CI Disperse Blue 149), M/P Red Brown S (CI Disperse Brown 1), M/P Navy Blue 3GS (CI Disperse Blue 205), M/P Navy Blue GLSF (CI Disperse Blue 79:1), M/P Navy Blue BGSF (CI Disperse Blue 187), M/P Navy Blue TNSF (CI Disperse Blue 207), M/P Navy Blue RRSF (CI Disperse Blue 186), and M/P Navy Blue TRSF (CI Disperse Blue 94).

Exemplary quinophthalone dyes include M/P Yellow 3GSL (CI Disperse Yellow 64), M/P Yellow F3G (CI Disperse Yellow 54), and M/P Yellow GSL (CI Disperse Yellow 149).

Exemplary anthraquinone dyes include M/P Yellow HLS (no CI name), M/P Red FB (CI Disperse Red 60), M/P Red 4BF (CI Disperse Red 207), M/P Red SL (mixture), M/P Red T4B (CI Disperse Red 229), M/P Red BLSF (CI Disperse Red 92), M/P Red Violet 4RL (CI Disperse Violet 35), M/P Red Violet FR (Ci Disperse Violet 38), M/P Red Pink REL (CI Disperse Red 91), M/P Blue FBL (CI Disperse Blue 56), M/P Blue FTK (CI Disperse Blue 56), M/P Blue VSL (CI Disperse Blue 56), M/P Blue TGSF (CI Disperse Blue 214), M/P Blue TSF (CI Disperse Blue 197), M/P Brill 5B (CI Disperse Blue 87), and M/P Brill BG (CI Disperse Blue 60). Other Dyes which can be used include M/P Yellow YL (CI Disperse Yellow 42), M/P Brill Red FGG (CI Disperse Red 277), M/P Brown G (mixture), and M/P Brown GF (mixture).

And disperse dyes which can be used include Amacron, Calcosperse, Dianix Fast, Dianix Light, Eastman Polyester, Esteroquinone, Foron, Genacron, Interchem Polydye, Kayalon Polyester, Latyl, Palanil, Resoline, Samaron, Terasil.

Other disperse dyes, for example, C.I. Disperse Yellow-54 or -64, and additionally an extender, pH regulator, disperse level dyeing agent, penetrating agent such as nonylphenol 10EO and sodium dodecylbenzenesulfonate and other dyeing assistant auxiliaries can be incorporated with the above dyes in order to improve dyeing speed or to regulate hue, when necessary.

On dyeing the aliphatic polyester filament, the disperse dye is dispersed in an aqueous medium to obtain a dyeing bath, a pH regulator and disperse level dyeing agent are added to the bath, when necessary, and successively the aliphatic polyester filament is immersed in the bath to carry out dyeing.

Three dyeing conditions; dyeing temperature, dyeing time and pH of the dye bath in particular, must be selected in order to improve dyeing property of the aliphatic polyester filament and to inhibit change of physical properties of the filament after dyeing.

The dyeing temperature is 70°–120° C., preferably 80°–100° C. The dyeing time is 0.5–2 hours, preferably 0.5–1 hour after reaching the dyeing temperature. The dye bath preferably has pH of 4–9 in the dyeing step.

By dyeing in the above range of the dyeing temperature, dyeing time and pH of the dye bath, the aliphatic polyester filament can be dyed with good reproducibility, the molecular weight lowering ratio of the aliphatic polyester resin can be additionally reduced to 20% or less after dyeing, and a filament which is excellent in level dyeing property and color fastness to light can be obtained while maintaining excellent properties.

By reducing the molecular weight lowering ratio to 20% or less, deterioration of properties due to dyeing, for example, the strength lowering ratio of the filament can be reduced to 50% or less, and thus a dyed aliphatic polyester filament having a fibre tensile strength of 2 g/denier or more can be obtained.

When the dyeing temperature is 70° C. or less, the dye exhibits a low percentage of exhaustion and dyeing power becomes poor. On the other hand, a dyeing temperature of 120° C. or more accelerates deterioration of the aliphatic polyester resin and unfavorably increases molecular weight reduction of the resin, even though the dyeing time and pH of the dye bath are regulated in a preferred range.

When the dyeing time is longer than 2 hours, the aliphatic polyester resin is liable to unfavorably increase molecular weight reduction due to immersion for a long time, even though the dyeing temperature and pH of the dye bath are regulated in a preferred range.

Further, when the dye bath has pH of less than 4 or more than 9, the deterioration of the aliphatic polyester resin is accelerated in the presence of acid or alkali and molecular weight reduction of the resin is unfavorably increased, even though the dyeing temperature and dyeing time are controlled in a preferred range.

EXAMPLE

To further illustrate this invention in detail, the examples and comparative examples are given hereinafter.

Evaluation Method

Following evaluation methods were employed in the examples.

(1) Dyed Filament

The filament to be dyed was previously drawn 10 times unless otherwise noted and heat treated by heat setting at 130° C. in the case of polylactic acid and at 90° C. in the case of polybutylene succinate, respectively for an hour.

(2) Evaluation on the Weight Average Molecular Weight of Dyed Filament

The weight average molecular weight (MW) of dyed filament was evaluated by gel permeation chromatography at a column temperature of 40° C. in a chloroform solvent by use of polystyrene standard sample as reference.

(3) Evaluation of Dyeing Property

Evaluation of dyeing property was carried out according to a colorimetric method of residual dye bath.

That is, an absorbance (optical density: OD) spectrum of each dye bath solution before and after dyeing was individually measured with an ultraviolet/visible region spectrometer.

Percentage of exhaustion was calculated by applying the OD value of the highest pear in the above spectrum to the following equation.

Percentage of exhaustion=[(OD before dyeing−OD after dyeing)/OD before dyeing]×100 (%)

(4) Evaluation of Color Fastness to Light

The color fastness to light was evaluated in accordance with JIS L-0842-88 (Fading Test Method by Carbon Arc Lamp).

The test was carried out by exposing a test specimen and blue scale in a carbon arc fadeometer at 63° C. for 40 hours. The judgment was carried out by comparing each color change of the test specimen and blue scale, respectively.

(5) Evaluation of Color Fastness to Rubbing

The color fastness to rubbing was evaluated in accordance with JIS L-0849-71 (Wet Method).

The test was carried out by mutually rubbing a test specimen and a white cotton fabric with a rubbing tester and thereafter judging the coloring degree of the white cotton fabric.

(6) Evaluation of Color Fastness to Water

The color fastness to water was evaluated in accordance with JIS L-0846-76 (Method B).

The test was carried out by treating a composite test specimen with water, successively drying the specimen, and judging color change and contamination.

(7) Evaluation of Filament Strength

The tensile strength of the filament was evaluated in accordance with JIS L-1015.

A series of "JIS L" test methods employed in the present specification is based upon the color fastness testing method specified in ISO (International Organization for Standardization) and thus has international universality.

Example 1

(1) Preparation of Dye Bath i) Preparation of dye blend

Following these dyes were blended in a ratio of 1:1:1 to prepare a black dye blend.

M/P Yellow RSE

M/P Red RSE

M/P Blue RSE ii) Preparation of pH buffer solution

Following compounds were mixed by dissolving in ion-exchanged water to prepare a pH buffer solution of pH 5.

Anhydrous solution acetate 9.07 g/l

Glacial acetic acid 2.0 ml/l

Disper TL 1.00 g/l

Wherein Disper TL was a dyeing additive (a surface active agent for use in a dispersing agent or level dyeing agent; manufactured by Meisei Chemical Co.) (the same shall apply hereinafter)

iii) Preparation of dye bath

The dye bath was prepared by dissolving 0.1 g of the dye blend in 150 ml of the above pH buffer solution.

(2) Dyed Filament

The filament used was 10 g of a yarn (hank) of polylactic acid having an weight average molecular weight of 136,000.

(3) Dyeing

The filament was immersed in the dye bath and dyed with sufficient stirring under the following temperature increase pattern.

0–20 minutes; room temperature→60° C.

20–60 minutes; 60° C.→100° C.

60–120 minutes; maintain at 100° C. for 60 minutes (4) Water Washing and Drying

After finishing the dyeing, polylactic acid yarn was taken out of the dye bath, sufficiently washed with city water, dehydrated and dried.

(5) Results i) Weight average molecular weight

Before dyeing; 136,000 (100%)

After dyeing; 116,000 (85%)

ii) Dyeing property; Percentage of exhaustion=87% iii) Color fastness to light=class 6 iv) Color fastness to rubbing=class 4 v) Color fastness to water=class 4 vi) Appearance change of the yarn after dyeing; no change vii) Fiber strength of the yarn Before dyeing; 3.8 g/d (100%)

After dyeing; 3.1 g/d (82%)

Example 2

(1) Preparation of Dye Bath i) Dye

Following blue dye was used.

M/P Blue RSE ii) Preparation of pH buffer solution

A pH buffer solution of pH 5 was prepared by the same procedures as Example 1.

iii) Preparation of dye bath

The dye bath was prepared by dissolving 0.1 g of the dye in 150 ml of the above pH buffer solution.

(2) Dyed Filament

The dyed filament was 10 g of a filament (hank) of polylactic acid having an weight average molecular weight of 136,000.

(3) Dyeing

The filament was immersed in the dye bath and dyed with sufficient stirring under the following temperature increase pattern.

0–20 minutes; room temperature→60° C.

20–60 minutes; 60° C.→90° C.

60–120 minutes; maintain at 90° C. for 60 minutes (4) Water Washing and Drying

After finishing the dyeing, polylactic acid filament was taken out of the dye bath, sufficiently washed with city water, dehydrated and dried.

(5) Results i) Weight average molecular weight

Before dyeing; 136,000 (100%)

After dyeing; 135,000 (99%)

ii) Dyeing property; exhaustion percentage=88% iii) Color fastness to light=class 6 iv) Color fastness to rubbing=class 4 v) Color fastness to water=class 4 vi) Appearance change of the filament after dyeing; no change vii) Tensile strength of the filament Before dyeing; 3.8 g/d (100%)

After dyeing; 3.6 g/d (95%)

Example 3

(1) Preparation of Dye Bath i) Dye

Following blue dye was used.

M/P Blue RSE ii) Preparation of pH buffer solution

A pH buffer solution of pH 5 was prepared by the same procedures as Example 1.

iii) Preparation of dye bath

The dye bath was prepared by dissolving 0.1 g of the dye blend in 150 ml of the above pH buffer solution.

(2) Dyed Filament

The dyed filament was 10 g of a filament (hank) of aliphatic polyester derived from succinic acid and 1,4-butanediol and has an weight average molecular weight of 122,000.

(3) Dyeing

The filament was immersed in the dye bath and dyed with sufficient stirring under the following temperature increase pattern.

0–20 minutes; room temperature→60° C.

20–60 minutes; 60° C.→90° C.

60–120 minutes; maintain at 90° C. for 60 minutes (4) Water Washing and Drying

After finishing the dyeing, aliphatic polyester filament was taken out of the dye bath, sufficiently washed with city water, dehydrated and dried.

(5) Results i) Weight average molecular weight

Before dyeing; 122,000 (100%)

After dyeing; 120,000 (98%)

ii) Dyeing property; exhaustion percentage=80% iii) Color fastness to light=class 6 iv) Color fastness to rubbing=class 3°~4 v) Color fastness to water=class 4°~5 vi) Appearance change of the filament after dyeing; no change vii) Tensile strength of the filament Before dyeing; 4.7 g/d (100%)

After dyeing; 4.5 g/d (96%)

Comparative Example 1

(1) Preparation of Dye Bath i) Dye

Following blue dye was used.

M/P Blue RSE ii) Preparation of pH buffer solution

A pH buffer solution of pH 5 was prepared by the same procedures as Example 1.

iii) Preparation of dye bath

The dye bath was prepared by dissolving 0.1 g of the dye in 150 ml of the above pH buffer solution.

(2) Dyed Filament

The dyed filament was 10 g of a filament (hank) of polylactic acid having an weight average molecular weight of 136,000.

(3) Dyeing

The filament was immersed in the dye bath and dyed with sufficient stirring under the following temperature increase pattern.

0–20 minutes; room temperature→60° C.

20–70 minutes; 60° C.→140° C.

70–130 minutes; maintain at 140° C. for 60 minutes (4) Water Washing and Drying

After finishing the dyeing, polylactic acid filament was taken out of the dye bath, sufficiently washed with city water, dehydrated and dried.

(5) Results i) Weight average molecular weight

Before dyeing; 136,000 (100%)

After dyeing; 93,000 (68%)

ii) Dyeing property; exhaustion percentage=88% iii) Color fastness to light=class 6 iv) Color fastness to rubbing=class 4 v) Color fastness to water=class 4°~5 vi) Appearance change of the filament after dyeing; no change vii) Tensile strength of the filament Before dyeing; 3.8 g/d (100%)

After dyeing; 1.5 g/d (39%)

Comparative Example 2

(1) Preparation of Dye Bath i) Dye

Following blue dye was used.

M/P Blue RSE ii) Preparation of pH buffer solution

A pH buffer solution of pH 5 was prepared by the same procedures as Example 1.

iii) Preparation of dye bath

The dye bath was prepared by dissolving 0.1 g of the dye in 150 ml of the above pH buffer solution.

(2) Dyed Filament

The dyed filament was 10 g of a filament (hank) of polylactic acid having an weight average molecular weight of 136,000.

(3) Dyeing

The filament was immersed in the dye bath and dyed with sufficient stirring under the following temperature increase pattern.

0–20 minutes; room temperature→60° C.

20–120 minutes; maintain at 60° C. for 100 minutes (4) Water Washing and Drying

After finishing the dyeing, polylactic acid filament was taken out of the dye bath, sufficiently washed with city water, dehydrated and dried.

(5) Results i) Weight average molecular weight

Before dyeing; 136,000 (100%)

After dyeing; 134,000 (99%)

ii) Dyeing property; exhaustion percentage=10% iii) Color fastness to light; not measured because of very inferior dyeing property.

iv) Color fastness to rubbing; not measured because of very inferior dyeing property.

v) Color fastness to water; not measured because of very inferior dyeing property.

vi) Appearance change of the filament after dyeing; no deformation vii) Tensile strength of the filament; not measured because of very inferior dyeing property Comparative Example 3

(1) Preparation of Dye Bath i) Dye

Following blue dye was used.

M/P Blue RSE ii) Preparation of pH buffer solution

A pH buffer solution of pH 5 was prepared by the same procedures as Example 1.

iii) Preparation of dye bath

The dye bath was prepared by dissolving 0.1 g of the dye in 150 ml of the above pH buffer solution.

(2) Dyed Filament

The dyed filament was 10 g of an undrawn filament (hank) of polylactic acid having an weight average molecular weight of 135,000.

(3) Dyeing

The filament was immersed in the dye bath and dyed with sufficient stirring under the following temperature increase pattern.

0–20 minutes; room temperature→40° C.

20–60 minutes; 40° C.→90° C.

60–120 minutes; maintain at 90° C. for 60 minutes (4) Water Washing and Drying

After finishing the dyeing, polylactic acid filament was taken out of the dye bath, sufficiently washed with city water, dehydrated and dried.

(5) Results i) Weight average molecular weight

Before dyeing; 135,000 (100%)

After dyeing; 132,000 (98%)

ii) Dyeing property; exhaustion percentage=84% iii) Color fastness to light=class 6 iv) Color fastness to rubbing=class 4 v) Color fastness to water=class 4 vi) Appearance change of the filament after dyeing; deformed and became rigid vii) Tensile strength of the filament; not measured because of deformation and rigidness Comparative Example 4

(1) Preparation of Dye Bath i) Dye

Following blue dye was used.

M/P Blue RSE ii) Preparation of pH buffer solution

A pH buffer solution of pH 5 was prepared by the same procedures as Example 1.

iii) Preparation of dye bath

The dye bath was prepared by dissolving 0.1 g of the dye in 150 ml of the above pH buffer solution.

(2) Dyed Filament

The dyed filament was 10 g of a filament (hank) of polylactic acid having an weight average molecular weight of 136,000.

(3) Dyeing

The filament was immersed in the dye bath and dyed with sufficient stirring under the following temperature increase pattern.

0–20 minutes; room temperature→60° C.

20–60 minutes; 60° C.→90° C.

60–240 minutes; maintain at 90° C. for 180 minutes (4) Water Washing and Drying

After finishing the dyeing, polylactic acid filament was taken out of the dye bath, sufficiently washed with city water, dehydrated and dried.

(5) Results i) Weight average molecular weight

Before dyeing; 136,000 (100%)

After dyeing; 102,000 (75%)

ii) Dyeing property; exhaustion percentage=91% iii) Color fastness to light=class 6 iv) Color fastness to rubbing=class 4 v) Color fastness to water=class 5 vi) Appearance change of the filament after dyeing; no deformation vii) Tensile strength of the filament Before dyeing; 3.8 g/d (100%)

After dyeing; 1.7 g/d (45%)

Comparative Example 5

(1) Preparation of Dye Bath i) Dye

Following blue dye was used.

M/P Blue RSE ii) Preparation of pH buffer solution

An aqueous solution was obtained by dissolving 1.00 g of DISPER TL (a dyeing additive manufactured by Meisei Chemical Co.) in 1 liter of ion exchange water.

The dye bath was prepared by dissolving 0.1 g of the dye in 150 ml of the aqueous solution. The dye bath had pH of 9.3.

(2) Dyed Filament

The dyed filament was 10 g of a filament (hank) of polylactic acid having an weight average molecular weight of 136,000.

(3) Dyeing

The filament was immersed in the dye bath and dyed with sufficient stirring under the following temperature increase pattern.

0–20 minutes; room temperature→60° C.

20–60 minutes; 60° C.→90° C.

60–120 minutes; maintain at 90° C. for 60 minutes (4) Water Washing and Drying

After finishing the dyeing, polylactic acid filament was taken out of the dye bath, sufficiently washed with city water, dehydrated and dried.

(5) Results i) Weight average molecular weight

Before dyeing; 136.000 (100%)

After dyeing; 105.000 (77%)

ii) Dyeing property; exhaustion percentage=86% iii) Color fastness to light=class 6 iv) Color fastness to rubbing=class 4 v) Color fastness to water=class 4 vi) Appearance change of the filament after dyeing; no change vii) Tensile strength of the filament Before dyeing; 3.8 g/d (100%)

After dyeing; 1.7 g/d (45%)

Results are summarized in Table 1.

In Table 1, PLA means polylactic acid, PBS means polybutylene succinate, and MW means an weight average molecular weight, respectively.

TABLE 1

| | Example 1 | Example 2 | Example 3 | Com. Example 1 |
|---|---|---|---|---|
| High polymer | PLA | PLA | PBS | PLA |
| Drawn/Undrawn | drawn | drawn | drawn | drawn |
| Dyeing | | | | |
| Temperature (°C.) | 100 | 90 | 90 | 140 |
| Time (min) | 60 | 60 | 60 | 60 |
| pH | 5 | 5 | 5 | 5 |
| MW Reduction (%) | 15 | 1 | 2 | 32 |
| Exhaustion (%) | 87 | 88 | 80 | 88 |
| Fastness | | | | |
| Light (class) | 6 | 6 | 6 | 6 |
| Rubbing (class) | 4 | 4 | 3°–4 | 4 |
| Water (class) | 4 | 4 | 4°–5 | 4°–5 |
| Tensile strength after dyeing (g/d) | 3.1 | 3.6 | 4.5 | 1.5 |
| Appearance change | no | no | no | no |
| Total evaluation | ○ | ○ | ○ | × |

| | Com. Example 2 | Com. Example 3 | Com. Example 4 | Com. Example 5 |
|---|---|---|---|---|
| High polymer | PLA | PLA | PLA | PLA |
| Drawn/Undrawn | drawn | undrawn | drawn | drawn |
| Dyeing | | | | |
| Temperature (°C.) | 60 | 90 | 90 | 60 |
| Time (min) | 100 | 60 | 180 | 60 |
| pH | 5 | 5 | 5 | 9.3 |
| MW Reduction (%) | 1 | 2 | 25 | 23 |

TABLE 1-continued

| | | | | |
|---|---|---|---|---|
| Exhaustion (%) | 10 | 84 | 91 | 86 |
| Fastness | | | | |
| Light (class) | — | 6 | 6 | 6 |
| Rubbing (class) | — | 4 | 4 | 4 |
| Water (class) | — | 4 | 5 | 4 |
| Tensile strength after dyeing (g/d) | — | — | 1.7 | 1.7 |
| Appearance change | no | deform and rigid | no | no |
| Total evaluation | × | × | × | × |

What is claimed is:

1. A method for dyeing an aliphatic polyester filament comprising dyeing the aliphatic polyester filament with a disperse dye, wherein the dyeing temperature is 70°–120° C., the dyeing pH is 4–9, and the dyeing time is 30–120 minutes, so as to obtain a lowering ratio of 20% or less after dyeing on a weight average molecular weight of the aliphatic polyester filament to be dyed.

2. The dyeing method according to claim 1 wherein the weight average molecular weight of the aliphatic polyester filament to be dyed has a lowering ratio of 5% or less after dyeing.

3. The dyeing method according to claim 1 wherein the aliphatic polyester is primarily derived from polybutylene succinate.

4. The dyeing method according to claim 1 wherein the dyeing temperature is 80°–100° C.

5. The dyeing method according to claim 1 wherein the aliphatic polyester filament is primarily derived from polylactic acid, a copolymer of lactic acid with other hydroxycarboxylic acid, aliphatic polyester obtained by condensation of aliphatic polyhydric alcohol with aliphatic acid, or a copolymer of polylactic acid with aliphatic polyester obtained by condensation of aliphatic polyhydric alcohol with aliphatic polybasic acid.

6. The dyeing method according to claim 1 wherein the aliphatic polyester filament is obtained by melt spinning and successive drawing and heat setting.

7. A method for dyeing an aliphatic polyester filament comprising dyeing the aliphatic polyester filament with a disperse dye, wherein the dyeing temperature is 70°–120° C., the dyeing pH is 4–9, and the dyeing time is 30–120 minutes, whereby the tensile strength of the aliphatic polyester filament is 2 g/denier or more after dyeing the aliphatic polyester filament.

8. The dyeing method according to claim 7 wherein the dyeing temperature is 80°–100° C.

9. The dyeing method according to claim 7 wherein the aliphatic polyester filament is primarily derived from polylactic acid, a copolymer of lactic acid with other hydroxycarboxylic acid, aliphatic polyester obtained by condensation of aliphatic polyhydric alcohol with aliphatic polybasic acid, or a copolymer of polylactic acid with aliphatic polyester obtained by condensation of aliphatic polyhydric alcohol with aliphatic polybasic acid.

10. The dyeing method according to claim 9 wherein the aliphatic polyester is primarily derived from polybutylene succinate.

11. The dyeing method according to claim 7 wherein the aliphatic polyester filament is obtained by melt spinning and successive drawing and heat setting.

12. The dyeing method according to claim 9 wherein the aliphatic polyester filament is obtained by melt spinning and successive drawing and heat setting.

* * * * *